United States Patent [19]

Guichard

[11] Patent Number: 4,958,783

[45] Date of Patent: Sep. 25, 1990

[54] CABLE OR WIRE GUIDE FOR A GUIDE SYSTEM

[75] Inventor: Pascal Guichard, Autun, France

[73] Assignee: Alcatel N.V., Amsterdam, Netherlands

[21] Appl. No.: 388,959

[22] Filed: Aug. 2, 1989

[30] Foreign Application Priority Data

Aug. 3, 1988 [FR] France ..... 88 10484

[51] Int. Cl.[5] ..... B65H 57/00

[52] U.S. Cl. ..... 242/157 R

[58] Field of Search ..... 242/157 R, 157.1; 254/389, 390, 393, 407; 226/168, 176, 177, 181, 186, 187

[56] References Cited

U.S. PATENT DOCUMENTS

| | | | |
|---|---|---|---|
| 1,941,250 | 12/1933 | Dale | 242/157.1 |
| 2,211,299 | 8/1940 | Smith | 242/157.1 |
| 2,458,573 | 1/1949 | Donahue | 242/157 R X |
| 2,933,264 | 4/1960 | Bullen et al. | 242/157.1 |
| 2,948,513 | 8/1960 | Krohn-Holm | 242/157 R X |
| 3,072,384 | 1/1963 | Apichell | 242/157 R X |
| 3,098,639 | 7/1963 | Bromberg | 242/157 R X |
| 4,437,601 | 3/1984 | Brooks | 242/157 R X |
| 4,756,489 | 7/1988 | De Varennes | 242/157 R X |

FOREIGN PATENT DOCUMENTS

| | | |
|---|---|---|
| 2508426 | 12/1982 | France . |
| 865020 | 10/1958 | United Kingdom . |

*Primary Examiner*—Stanley N. Gilreath

[57] ABSTRACT

A cable or wire guide for a system for guiding a cable or wire (1) onto a drum or reel, the guide being characterized in that it comprises two rollers (9, 10) disposed on either side of the normal advance axis of the cable or wire, the rollers being carried at the ends of two symmetrical rocker arms (16, 18) rocking about fixed shafts (17, 19) disposed symmetrically about the advance axis, the rocker arms being connected to each other at the above-mentioned ends by means of a spring (15) urging the ends towards each other, and being hinged at their opposite ends (21, 24) to symmetrical correcting rods (20, 23) hinged to the head (7) of a rectangular slide (26) engaged with a small amount of play in a slideway (27) of width slightly greater than the width of the slide, such that the rollers bear against the cable to guide it even if the cable is angularly offset relative to its normal advance axis, while nevertheless allowing the rollers to move apart from each ther whenever the cable present a diameter defect (3).

2 Claims, 1 Drawing Sheet

CABLE OR WIRE GUIDE FOR A GUIDE SYSTEM

The present invention relates to a cable or wire guide for a guide system for guiding a cable or wire onto a drum or reel.

BACKGROUND OF THE INVENTION

In such devices, the cable or wire must be guided close to the drum or reel onto which it is to be wound in successive layers, by means of a member which leaves it with very little latitude for sideways displacement relative to an axis lying in a plane perpendicular to the axis of the drum or reel, thus constraining it to pass through a zone which is very little larger than its diameter, while nevertheless avoiding any risk of jamming when the cable has a defect of significantly increased diameter, e.g. due to excess thickness of its insulating sheath.

Cable guides have already been proposed which are constituted by a set of two rollers each carried by a screw, with the screws lying on a common axis parallel to the axis of the drum, and with one of them having a right-handed thread and the other a left-handed thread. The rollers then withstand the forces exerted by a defect in the cable or wire constituted by a diameter greater than the gap between the rollers, and as a result they do not let the cable through, thereby jamming the guide system and possibly breaking the cable or wire.

Cable guides have also been proposed which are constituted by a set of two rollers each carried at the end of a compression spring. When a defect arrives, the rollers move apart to let it through. However, if the cable is presented at a certain angular offset relative to the plane perpendicular to the axis of the drum or reel, then the roller against which the cable bears retracts whenever the cable applies a force thereto greater than a certain limit, in which ca==the cable is no longer properly guided.

The object of the present invention is to provide a cable or wire guide which withstands the forces exerted thereon by a cable or wire when presented thereto at a certain angular offset relative to a plane perpendicular to the axis of the drum or reel, but which nevertheless allows cable or wire defects of considerably greater diameter than normal to pass therethrough.

SUMMARY OF THE INVENTION

The cable or wire guide of the invention includes the improvement whereby it comprises two rollers disposed on either side of the normal advance axis of the cable or wire, the rollers being carried at the ends of two symmetrical rocker arms rocking about fixed shafts disposed symmetrically about said advance axis, said rocker arms being connected to each other at said ends by means of a spring urging said ends towards each other, and being hinged at their opposite ends to symmetrical connecting rods hinged to the head of a rectangular slide engaged with a small amount of play in a slideway of width slightly greater than the width of the slide, such that the rollers bear against the cable to guide it even if the cable is angularly offset relative to its normal advance axis, while nevertheless allowing the rollers to move apart from each other whenever the cable presents a diameter defect.

Preferably, the hinges between the rocker arms and the connecting rods and between the connecting rods and the slide head are constituted by ball sleeves.

BRIEF DESCRIPTION OF THE DRAWING

An embodiment of the invention is described by way of example with reference to the accompanying drawing, in which.

DETAILED DESCRIPTION

Figure 1:
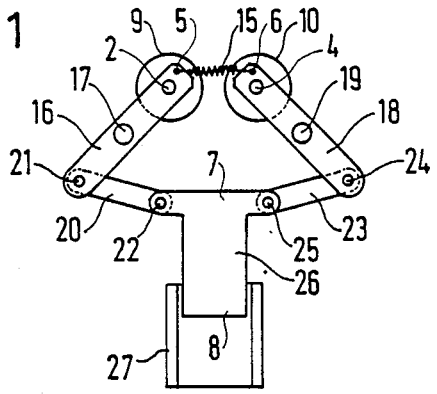
FIG. 1 is an overall view of the system.

In the system shown in FIG. 1, rollers 9 and 10 are carried on shafts 2 and 4 disposed at the end of symmetrical rocker arms 16 and 18 pivoting about fixed shafts 17 and 19 fixed to a slideway 27 by connections that are not shown. A traction spring 15 has its ends fixed at 5 and 6 to the ends of the rocker arms. Their opposite ends are hinged via sleeve-shaped ball bearings 21 and 24 (or other elongated low-friction bearings to symmetrically disposed connecting rods 20 and 23 connected to the head 7 of a rectangular slide 26. The connecting rods 20 and 23 are themselves hinged to the slide head by respective sleeve-shaped ball bearing 22 and 25.

The shank 8 of the slide 26 is engaged in a rectangular slide 27 whose inside width is slightly greater than the outside width of the slide. The play between the slide and the slideway and the nature of the materials used, and optionally the state of the facing surfaces, should all be such that a limited couple applied to the slide by the hinges 22 and 25 gives rise to a considerable jamming force preventing the slide from sliding in the slideway.

Figure 2:
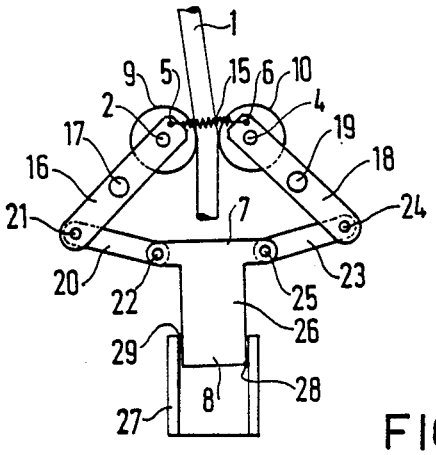
FIG. 2 shows the position taken up by the system when the cable is tending to urge the left-hand roller towards the left of the figure.

FIG. 2 shows the position taken up by the system when the cable 1 is urging the left-hand roller 9 to the left in the figure, as may occur, for example, when the cable is being wound onto the drum from right to left and the translation speed of the drum relative to the cable guide is slightly less than to the speed corresponding to the cable being wound in touching turns.

The cable then urges the end of arm 16 to the left which pivots anticlockwise about its fixed shaft 17. The hinge 21 between the arm 17 and the connecting rod 20 pivots in the same direction and urges the connecting rod 20 and consequently its hinge 22 with the head 7 of the slide 26 downwards and to the right in the figure.

In addition, the top end of the right-hand rocker arm is urged to the left in the figure by the connecting spring 15. The right-hand rocker arm 18 also pivots anticlockwise about its fixed shaft 19. Its hinge 24 connected to the connecting rod 23 is urged towards the right. This connecting rod thus pulls its hinge 25 with the head 7 of the slide 26 towards the right.

Under the combined effect of these two forces, the slide 26 is subjected to a rotary couple tending to jam it in the slideway 27 and it makes contact therewith at a point 29 at the top of the slideway and a point 28 inside the slideway. The roller 9 is thus prevented from moving further to the left and the roller remains in contact with the cable 1 which continues to be guided.

Figure 3:
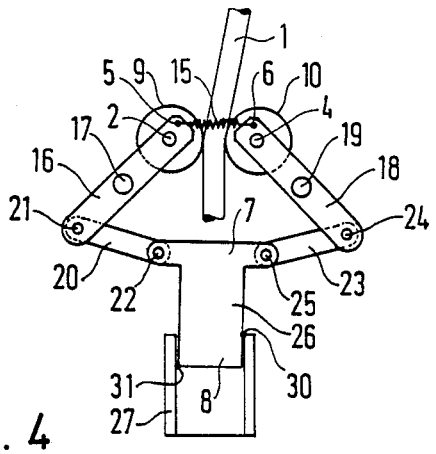
FIG. 3 shows the position taken up by the system when the cable is urging the right-hand roller towards the right of the figure.

FIG. 3 shows the position taken up by the system when the cable tends, on the contrary, to urge the right-hand roller 10 to the right, as may happen, for example, when the cable is being wound onto the drum from left to right with the speed of translation of the drum relative to the cable guide being a little less than the speed which corresponds to touching turns being wound on the drum.

In a manner which is symmetrical to that described with reference to FIG. 2, the top end of arm 18 is urged to the right so the arm rotates clockwise about its shaft 19. This urges the connecting rod 23 and the head 7 of the slide 27 to the left and downwards in the figure, thereby applying a rotary couple to the slide. The slide 26 thus jams in the slidway 27 at points 30 and 31. The left-hand roller 9 is urged to the right by the traction spring 15 and the rocker arm 16 tends to move to the left, thereby contributing to jamming the slide 26 in the slideway. The right-hand roller 10 is locked in position and remains in contact with the cable 1 so it continues to be guided.

Figure 4:
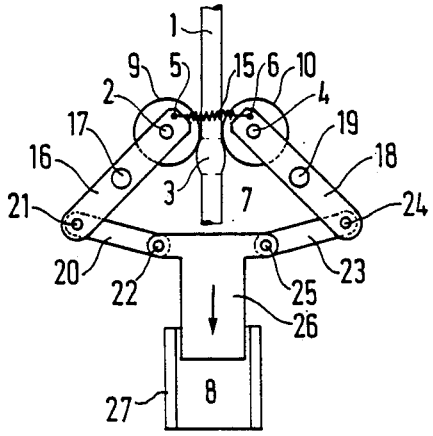
FIG. 4 shows the position taken up by the system when the cable has a diameter defect.

FIG. 4 relates to the case when a diameter defect 3 in the cable occurs between the guide rollers, and in particular when the sheath of the cable is of excess thickness and takes up the form of a swelling having a diameter greater than the normal diameter of the cable. The swelling presses simultaneously against both rollers, urging the roller 9 to the left and the roller 10 to the right through substantially equal amounts if the defect is substantially symmetrical. Both of the rocker arms 16 and 18 pivot about their respective axes. They then transmit a force via the connecting rods 20 and 23 onto the slide which tends to slide into its slideway without jamming therein since the symmetrical forces do not apply a rotary couple on the slide. Both rollers move apart symmetrically allowing the swelling to pass, and then return towards each other because of the spring 15 as soon as the swelling has passed completely. Cable guidance is therefore not interrupted.

If a defect is not disposed symmetrically about the axis of the cable, then the cable axis at the defect is displaced so as to coincide with the overall pulling direction on the cable as determined by the points of contact between the cable and the winding and the guide members upstream from the cable guide. The cable axis needs to be displaced very little to enable the slide 26 to slide in the slideway 27 normally in the same manner as in the cases shown in FIGS. 2 and 3.

I claim:

1. A guide for guiding a cable onto a reel along a normal advance axis lying in a guide plane perpendicular to a rotational axis defined by the reel, wherein the guide comprises:

first and second fixed shafts disposed symmetrically about said guide plane, first and second rocker arms symmetrically configured with respect to each other and each having a first end and a second end, as well as an intermediate bearing rotationally mounted to a respective one of said fixed shafts first and second rollers each carried at a respective first end of a respective one of said rocker arms a spring connected between the two first ends of the rocker arms for urging said first ends towards each other, a slideway symmetrically disposed with respect to said advance plane a slide having a head portion and a tail portion, with the tail portion slidingly engaged with a small amount of play in the slideway so as to constrain said head portion to travel substantially along a slide axis lying in said guide plane, first and second connecting rods symmetrically configured with respect to each other and each having a first end and a second end, with each said first end hinged to said head portion of the slide and with each said second end hinged to a respective second end of a respect said rocker arm, whereby the rollers remain symmetrically disposed about said guide plane and bear against any cable passing therebetween even if the cable is angularly offset relative to said guide plane, and the rollers are free to move apart from each other whenever an enlarged cable diameter is encountered.

2. A cable guide according to claim 1, wherein the hinges between the rocker arms and the connecting rods and between the connecting rods and the head portion of the slide comprise sleeve-shaped low-friction bearings.

* * * * *